US005619812A

United States Patent [19]

Hensel et al.

[11] Patent Number: 5,619,812

[45] Date of Patent: Apr. 15, 1997

[54] HEEL REST FOR AN IRON

[75] Inventors: Keith J. Hensel, North Sydney; Richard L. Hoare, Neutral Bay, both of Australia

[73] Assignee: Sunbeam Products, Inc., Fort Lauderdale, Fla.

[21] Appl. No.: 555,703

[22] Filed: Nov. 14, 1995

[51] Int. Cl.[6] ..... D06F 75/40

[52] U.S. Cl. ..... 38/88; 219/259

[58] Field of Search ..... 38/88, 91, 96; 219/259, 256, 520; 248/51

[56] References Cited

U.S. PATENT DOCUMENTS

| | | | |
|---|---|---|---|
| D. 316,621 | 4/1991 | Van Surksum | D32/70 |
| D. 317,519 | 6/1991 | Van Surksum | D32/70 |
| D. 326,939 | 6/1992 | Gudefin | D32/70 |
| D. 349,377 | 8/1994 | Stutzer et al. | D32/70 |
| D. 349,378 | 8/1994 | Simmon | D32/70 |
| 4,347,428 | 8/1982 | Conrad et al. | 219/259 X |
| 4,357,519 | 11/1982 | Bain, Jr. | 219/259 X |
| 5,094,021 | 3/1992 | Chen | 38/88 X |
| 5,390,433 | 2/1995 | Brady | 38/88 X |

FOREIGN PATENT DOCUMENTS

| | | |
|---|---|---|
| 2054327 | 3/1978 | Germany . |
| 3075100A | 3/1990 | Japan . |

*Primary Examiner*—Ismael Izaguirre

*Attorney, Agent, or Firm*—Michael J. Kline; Charles E. Kosinski

[57] ABSTRACT

The present invention relates to a heel rest for an iron. More specifically, the heel rest of the present invention, comprises a recess to improve the stability of an iron in its upright position on a soft surface, such as a padded ironing board or carpet. As the iron is placed in the upright position, the weight of the iron presses down upon the soft surface and causes the soft surface located directly under the recess to rise and fill in to the recess.

15 Claims, 5 Drawing Sheets

HEEL REST FOR AN IRON

FIELD OF THE INVENTION

The present invention relates to a heel rest for an iron. More specifically, the heel rest of the present invention, comprises a recess to improve the stability of an iron in its upright position on a soft surface, such as a padded ironing board or carpet. As the iron is placed in the upright position, the weight of the iron presses down upon the soft surface and causes the soft surface located directly under the recess to rise and fill into the recess.

DISCUSSION OF THE PRIOR ART

Generally, the ironing of clothing occurs on an ironing board. The ironing board comprises a flat surface and is usually manufactured from metal or wood. As the soleplate of the iron contacts the surface of the ironing board, high temperatures result, which may cause the fabric being ironed to burn. As a result, padding is generally placed between the ironing board and the ironing board cover to function as insulation between the ironing board and iron. The padding may even be incorporated directly into the manufacture of the ironing board cover. The padding also serves an additional purpose of providing a more smooth and soft surface, to enable the iron to more freely and smoothly traverse the surface of the fabric.

Generally, when a person is adjusting the article to be ironed, the iron is left supported by the heel of the iron in an upright position. When a person is finished ironing, the iron is placed in an upright position on the ironing board, or the carpet. One reason for placing the iron in an upright position is the high temperatures that the soleplate of the iron may reach, e.g. temperatures greater than the boiling temperature of water. As a result, if the iron tips over onto the fabric being ironed, furniture or carpet may burn or discolor. In addition, a steam iron left in its vertical position may leak water from the pores of the soleplate onto an item, such as the fabric being ironed, furniture or carpet, thus, possibly staining the item. Accordingly, it is desirable to have an iron which will remain stable in its upright position.

The irons of the prior art contain rear covers or heel rests having a shape or a configuration not conducive to providing stability to an iron in the upright position for soft surfaces.

Generally, heel rests for irons are flat, smooth and may contain a plurality of ridges. Such irons are disclosed in Van Surksum, U.S. Design No. 316,621 and 317,519; Gudefin, U.S. Design No. 326,939; Stutzer, et al., U.S. Design No. 349,377; and Simmon, U.S. Design No. 349,378. Irons having a heel rest are also disclosed in Japanese Patent No. 03-075100-A and German Patent No. 20 54 327.

Generally, irons having a generally flat heel rest tend to tip over on a soft padded surface, thus, burning the person ironing the clothes or causing a danger to the household.

SUMMARY OF THE INVENTION

The preferred embodiment of the present invention relates to an iron having a heel rest comprising a recess. The heel rest includes a front and back side. The back side includes a plurality of protrusions for removably fastening the heel rest to the housing of the iron. In addition, the back side may also include a means for removably fastening a portion of the power cord to the heel rest.

The front side of the iron heel rest includes a recess to receive a soft surface, such as the soft padding for an ironing board, fabrics or carpets. In a most preferred embodiment, the iron heel rest is generally shaped in a trapezoidal form. The flat portion of the recess is also generally trapezoidal in shape, with an inwardly sloping perimeter surface located between the circumference of the heel rest and the flat surface of the recess.

It is an object of the present invention to provide an iron which overcomes the problems of the prior art.

It is a further object of the present invention to provide an iron comprising a heel rest having a recess in which the iron will be less likely to tip over while in its upright position on a soft surface.

DETAILED DESCRIPTION OF THE PREFERRED EMBODIMENTS

Figure 1:
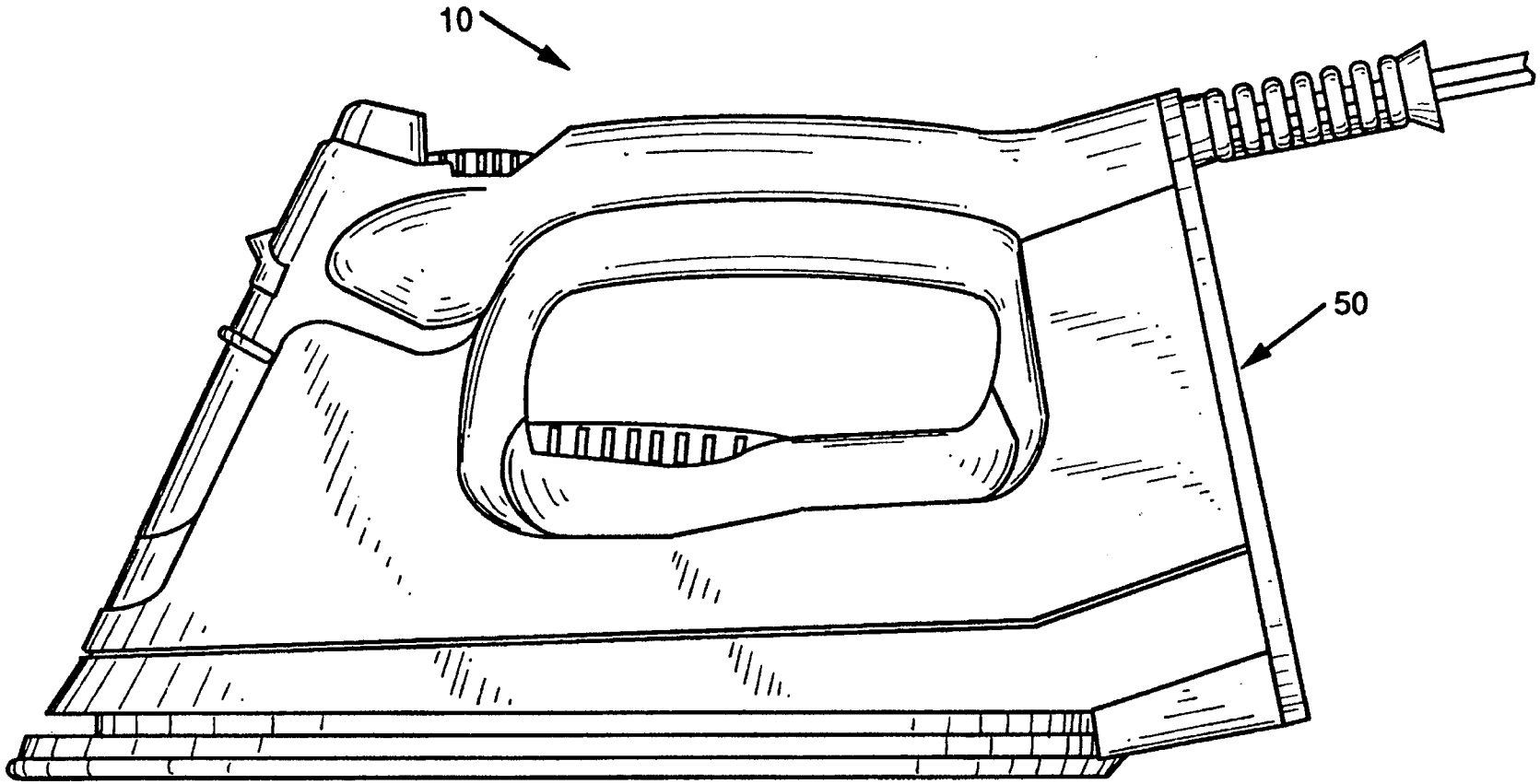
FIG. 1 is a side elevational view of an iron comprising a heel rest of the present invention.
Figure 2:
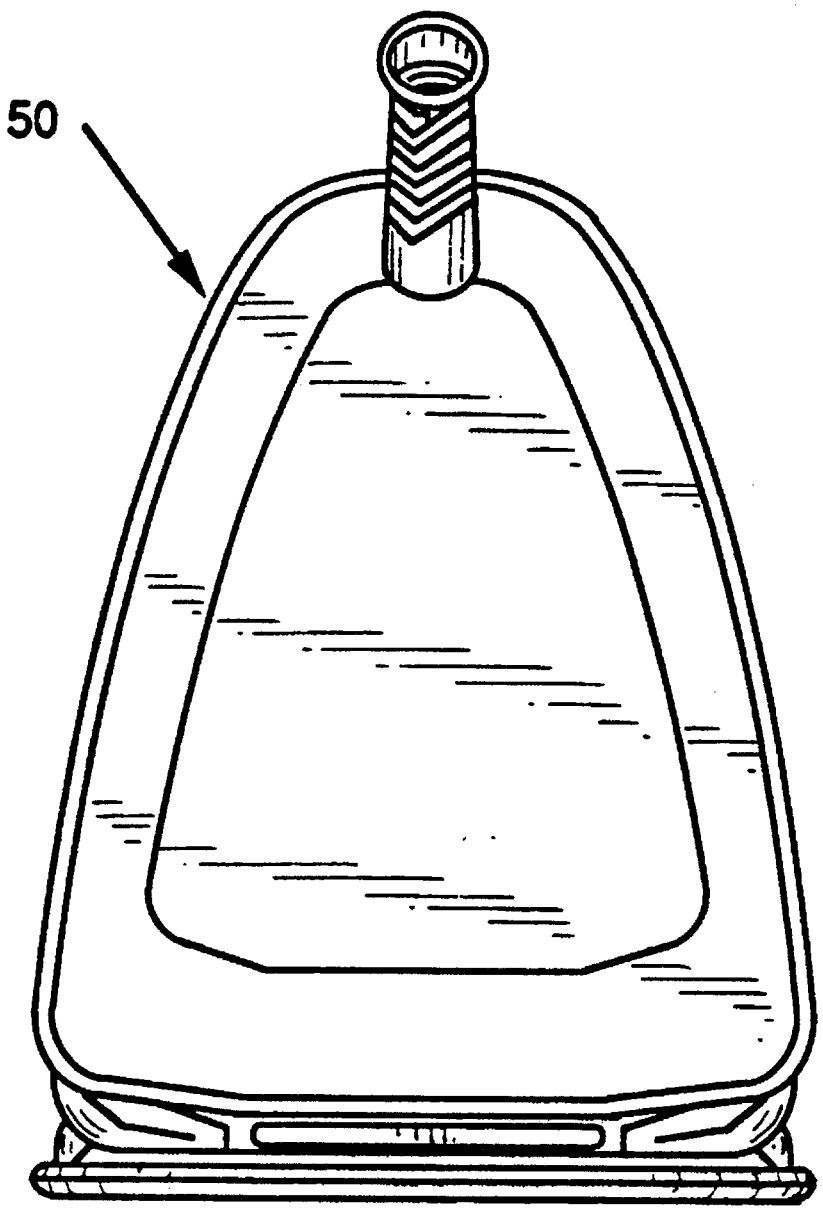
FIG. 2 is a rear elevational view of an iron comprising a heel rest of the present invention.

FIGS. 1 and 2 shows one embodiment of an electric steam iron 10 comprising a heel rest 50 of the present invention.

Figure 3:
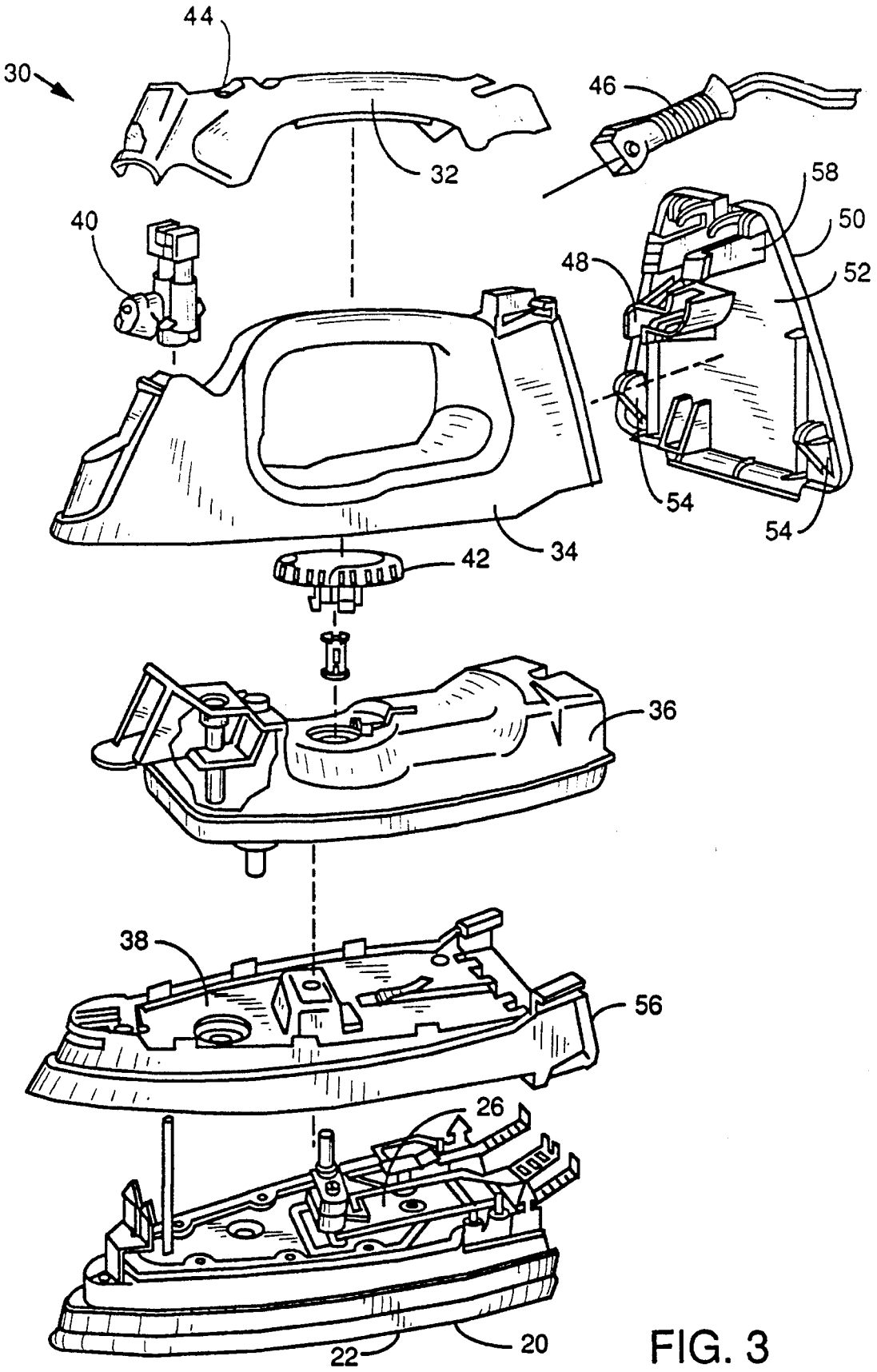
FIG. 3 is an exploded perspective view of an iron comprising the heel rest of the present invention.

FIG. 3 illustrates an exploded view of the iron 10 of FIGS. 1 and 2. The iron 10 comprises a soleplate 20, a heating element 26, a housing 30, a pump assembly 40, a steam control assembly 42, and the heel rest or rear cover 50 of the present invention. Of course, the heel rest 50 of the present invention may be adapted to be fastened to any type of iron. In addition, the heel rest 50 may be made of any material such as ABS plastic, polypropylene, wood, metals, etc.

As shown in FIG. 3, the soleplate 20 comprises a metal material and also a heating element 26 mounted in good heat conducting relationship therewith. The soleplate 20 also has a bottom face or pressing surface 22 adapted to be placed in contact with a suitable fabric to be ironed.

In a preferred embodiment, the housing 30 of the iron 10 comprises a top cover 32, a handle 34, a tank 36, and a skirt 38. The soleplate 20 is secured to the other parts of the housing 30 such as the skirt 38 through the use of screws, flanges, or any other conventional means for fastening.

The tank 36, which may be filled with an aqueous solution such as water, is removably connected to the skirt 38. Water contained in the tank 36 may be delivered to the soleplate 20 where it is converted to steam in a well-known manner. The water delivery is controlled by a steam setting control 42, which controls a steam valve. The tank 36 which fits between the skirt 38 and handle 34 is completely encapsulated by the handle 34, which fits over the skirt 38.

A pump assembly 40 fits between the handle 34 and the top cover 32. The pump assembly 40 draws water from the tank 36 and delivers a spray of water to dampen the fabrics to be ironed.

The top cover 32 fits over the handle 40 and a fastening means 44 is provided such as a screw to secure the top cover 32 to one or more parts of the housing 30 or the soleplate 20. The power cord assembly 46 is either fixably or removably attached to the heating element 26 and may also be removably secured to the heel rest 50 by a power cord assembly fastening means 48 such that the power cord assembly 46 extends outward between the heel rest 50, the top cover 32 and the handle 34.

As shown in FIG. 3, in a most preferred embodiment, the back side 52 of the heel rest 50 of the present invention includes a pair of engaging lower tail pieces 54 having respective apertures 56 located in the skirt 38 for engagement with the skirt 38. In addition, the heel rest 50 may also contain tail pieces or protrusions 58 to engage the heel rest 50 with the top cover 32 or handle 34 or both. Any number of tail pieces or protrusions 54, 58, however, can be used to fasten the heel rest 50 to the housing 30 of the iron 10. In addition, other means for fastening the heel rest 50 to the iron 10 are also contemplated, e.g. screws, nails, clips, flanges, etc.

Figure 4:
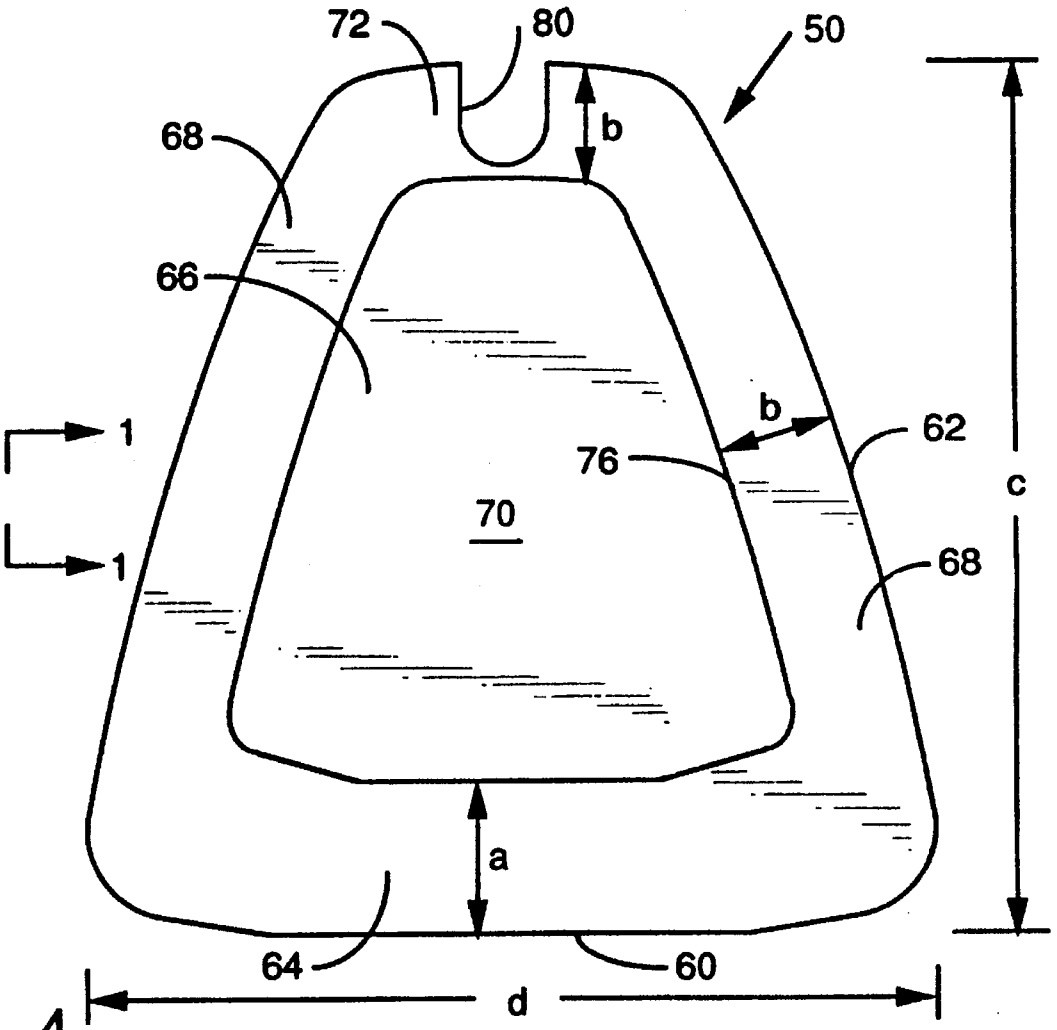
FIG. 4 is a rear elevational view of the heel rest.

As shown in FIG. 4, the front side 60 of the heel rest 50 embodies the main feature of this invention. In a preferred embodiment, the heel rest 50 is contained in a trapezoidal shape having rounded off corners. Of course, any shape such as a square, triangle, polygon, or circle may be utilized.

Figure 5:
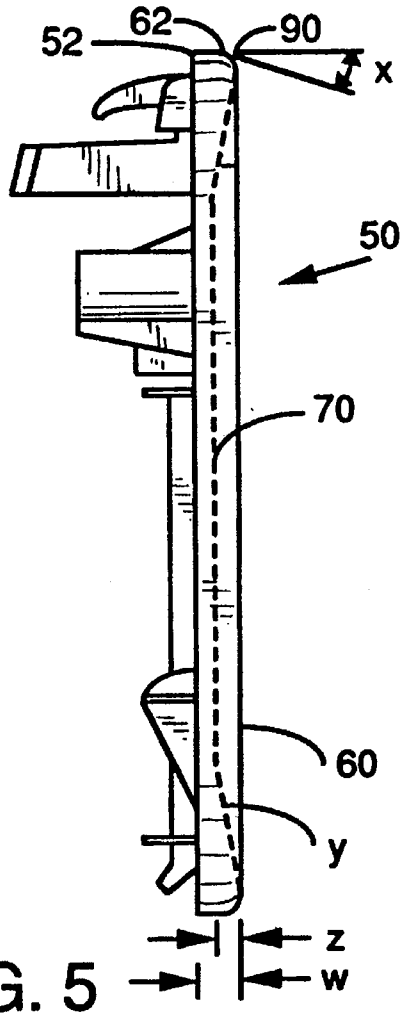
FIG. 5 is a cross-sectional view of the heel rest of FIG. 4, taken generally long line 1—1 of FIG. 1, and showing details of the recess.

As shown in FIG. 5, the thickness (w) of the heel rest 50 excluding the fastening protrusions may be any length from 1 mm to 5 cm. In a most preferred embodiment, the thickness (w) is 4.5 mm.

In a preferred embodiment, illustrated in FIG. 5, the heel rest 50 has a rounded edge 62 which confronts an inwardly beveled perimeter portion 90. The perimeter portion 90 slopes inwardly toward a planar recessed surface 70 at an angle (x) ranging from 2 degrees to 15 degrees. The outer radius of the front side is less than the outer radius of the back side. In a most preferred embodiment, this angle is 2 degrees.

From the front side 60 of the heel rest 50, the perimeter portion preferably slopes toward the center of the front side of the heel rest at an angle (y) ranging from 2 degrees to 10 degrees for a certain distance until the recess 70 comprises a depth (z) of approximately 1.0–3.0 mm. In a most preferred embodiment, the angle (y) is 4 degrees, and the depth (z) is approximately 2.5 mm.

As shown in FIG. 4, at the bottom portion 64 of the heel rest 50, the distance (a) from the outer radius 62 to the flat portion 66 of the recess 70 is approximately 22.0 mm. In the side portion 68 and upper portion 72, the distance (b) from the outer radius 62 to the flat portion 66 is approximately 17.0 mm. Preferably, the sides 76 of the flat portion 66 of recess 70 are parallel to the outer radius 62 of the heel rest 50.

In a most preferred embodiment, the height (c) of the heel rest 50 is approximately 126.24 mm. The width (d) of the front side 60 of the heel rest 50 is approximately 116.4 mm. Of course, the heel rest 50 of the present invention can also be implemented in heel rests of differing heights and widths.

In addition, an opening 80 may be included in the top portion of the heel rest 50 to allow a power cord assembly to protrude outwards.

Figure 6:
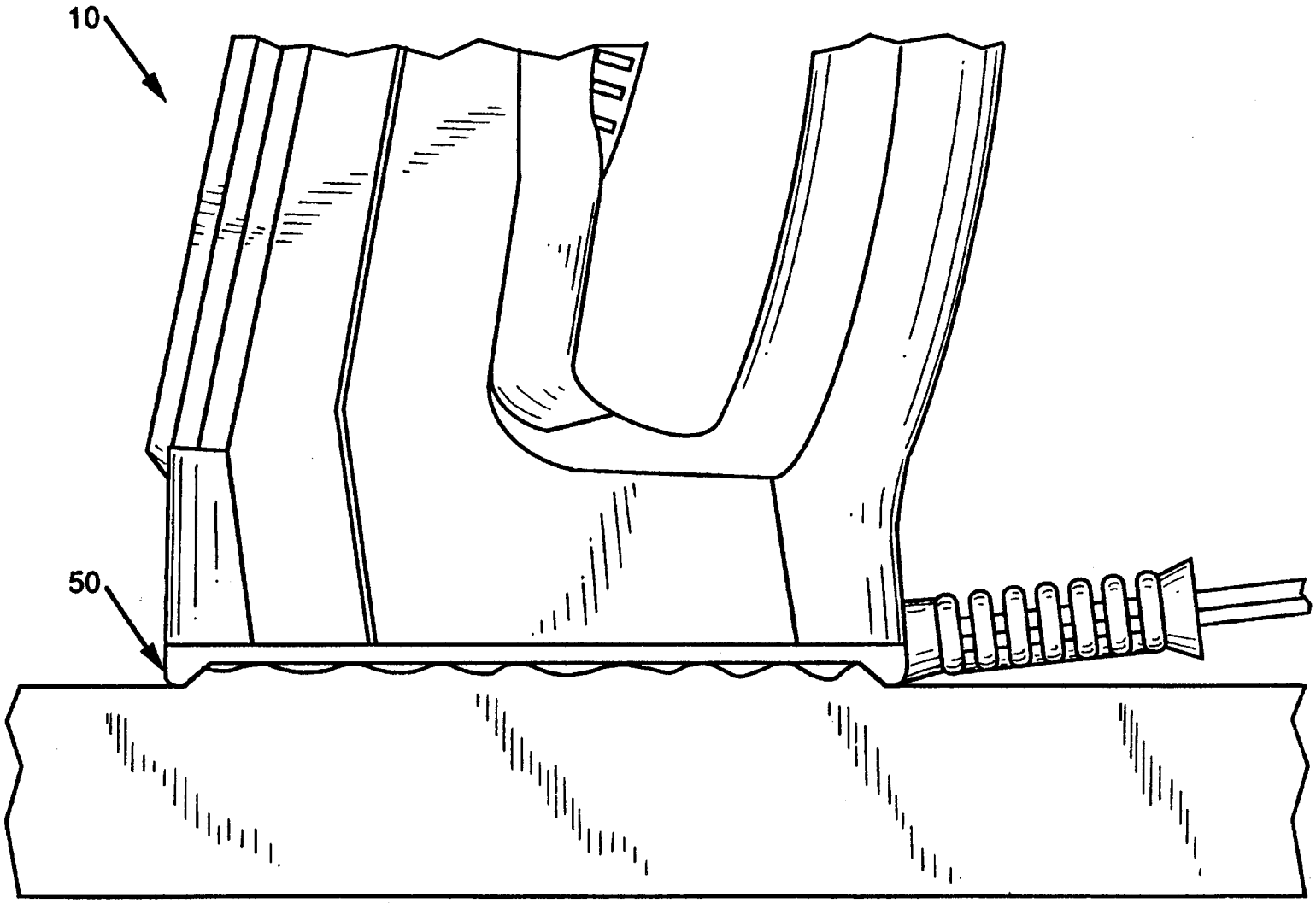
FIG. 6 is an elevational view of the bottom portion of the iron in its upright position comprising the preferred embodiment of a heel rest of the present invention wherein a soft surface is disposed within the recess.

As shown in FIG. 6, the iron 10 is resting on its heel rest 50 in the upright position. As the weight of the iron forces the soft surface downwards, the portion of the soft surface directly underneath the recess moves upward to fill in the recess. As a result, the soft surface in the recess acts as a barrier in the recess to prevent the iron from tipping over.

EXAMPLE 1

An experiment was performed to determine the improved degree of stability in an iron using a heel rest of the present invention. The iron incorporating the heel rest of the present invention was designated as Sunbeam Products, Inc. ("SUNBEAM") STEAMMASTER 2 type irons. In particular, STEAM MASTER 2, Model No. 4048 was tested.

The stability test was performed using five (5) different irons, each from a different manufacturer. The five irons are:

A=Sunbeam Model No. 4048 (STEAM MASTER 2);

B=Rowenta Model No. DE 44 (SURFLINE);

C=Proctor Silex Model No. 17260;

D=Tefal Model No. 1960 (ULTRAGLIDE ELITE 60);

E=Panasonic Model No. NI-432E.

The test was performed three times. The results shown in Table 1 are an average of all three tests.

The test was set up in the following manner:

Each unit was filled with water to its maximum level. Next, the unit was placed in an upright position on its heel rest onto a 0.200 inch thick rubber pad, which was placed on top of a table. The side of the table directly opposite the soleplate was raised until the unit moved from its upright position to a vertical position. After the unit moved, the angle of the table top was lowered to find the most accurate point of movement. The unit was then rotated to find another direction that might cause the iron to move. If another direction was found, the angle of the table top was lowered until the unit would stop moving. The unit would then be rotated again until no new direction was found which could cause movement of the iron. The angle was then recorded.

In Table 1, a diagram of the test results are shown. The rectangle corresponds to a table top, which has been divided into quadrants. The table top is oriented so that the back edge is marked by line A. The "X" marks the direction of the base plate. In this diagram, the degree of the angle at which the unit tips over is shown.

As shown in Table 1, the STEAM MASTER 2 iron, which contained the heel rest of the present invention, tipped over when the table top was raised to an angle of 19.6 degrees. The next closest unit in terms of performance was the Proctor-Silex unit which tipped over at an angle of only 14.5 degrees. Accordingly, the STEAM MASTER 2 iron was significantly superior than the other four units in remaining in an upright position.

Although the invention has been described in detail in the foregoing for purposes of illustration, it is to be understood that such detail is solely for that purpose and that variations can be made therein by those of ordinary skill in the art, without departing from the spirit and scope of the invention as defined by the claims. Such variations are specifically intended to be embraced by the scope for the following claims and by all equivalents thereof.

TABLE 1

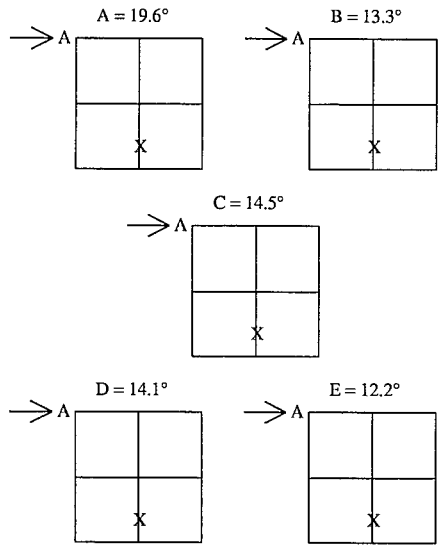

We claim:

1. An iron comprising:

a) a housing;

b) a soleplate connected to said housing; and c) a rear cover means connected to said housing, said rear cover means having a planar recess for stabilizing said iron in an upright position on a surface, said planar recess comprising an inwardly sloped portion surrounding an inner flat portion, said inner flat portion comprising a maximum depth of said planar recess ranging from 1.0 to 3.0 mm, said inwardly sloped portion sloping inward at an angle ranging from 2 to 15 degrees, said rear cover means having a height of approximately 126.0 mm and a width of approximately 116.0 mm.

2. An iron according to claim 1, wherein said housing comprises a skirt fastened to said soleplate; a tank removably disposed above said skirt; a handle removably fastened to said skirt and encapsulates said tank; and a fastening means for securing a top cover to said handle, said tank, said skirt, and said soleplate.

3. An iron according to claim 1, wherein said planar recess of said rear cover means has a maximum depth of 2.5 mm.

4. An iron according to claim 1 wherein said rear cover means has a thickness ranging from 1 mm to 5 cm.

5. An iron according to claim 4 wherein said rear cover means has a thickness of 4.5 mm.

6. An iron according to claim 1, wherein said rear cover means comprises means for enabling a power assembly cord to exit the interior of said iron.

7. An iron according to claim 1, wherein said rear cover means comprises a front side and a back side; said back side comprises a fastening means for removably securing a power assembly cord to said back side of said rear cover means.

8. An iron according to claim 7, wherein said back side of said rear cover means comprises an outer radius and said front side of said rear cover means comprises a second outer radius; said outer radius of said back side slopes inward at an angle ranging from 2 to 15 degrees until the second outer radius of said front side is reached.

9. An iron according to claim 8, wherein said angle is 2 degrees.

10. An iron according to claim 1, wherein said angle is 4 degrees.

11. An iron according to claim 1, wherein said rear cover means is trapezoidal in shape.

12. An iron according to claim 1, wherein said rear cover means is connected to said housing by a plurality of fins.

13. An iron according to claim 1, wherein said planar recess is surrounded by a perimeter portion, said perimeter portion forming an obtuse angle with respect to said planar recess.

14. An iron comprising:

a) a housing;

b) a soleplate connected to said housing; and c) a rear cover means having a planar recess for stabilizing said iron in an upright position on a surface;

said rear cover means comprising a front side and back side;

said back side comprising a fastening means for removably securing a power assembly cord to said back side of said rear cover means;

said planar recess comprising an inwardly sloped perimeter portion surrounding an inner flat of said planar recess ranging from 1.0 to 3.0 mm, portion, said perimeter portion having a width ranging from approximately 17.0 mm to 22.0 mm, said inner flat portion comprising a maximum depth of approximately 2.5 mm, said perimeter portion forming an angle with respect to said inner flat portion ranging from 2 to 10 degrees; said rear cover means having a height of approximately 126.0 mm and a width of approximately 116.0 min.

15. An iron according to claim 14, wherein said angle is 4 degrees.

* * * * *